US011378908B2

(12) United States Patent
Haga

(10) Patent No.: US 11,378,908 B2
(45) Date of Patent: Jul. 5, 2022

(54) IMAGE FORMING APPARATUS AND PROGRAM

(71) Applicant: Konica Minolta, Inc., Tokyo (JP)

(72) Inventor: Masayasu Haga, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 17/371,788

(22) Filed: Jul. 9, 2021

(65) Prior Publication Data

US 2022/0057743 A1 Feb. 24, 2022

(30) Foreign Application Priority Data

Aug. 21, 2020 (JP) ..... JP2020-140290

(51) Int. Cl.
*G03G 21/00* (2006.01)
*G03G 15/00* (2006.01)

(52) U.S. Cl.
CPC ..... *G03G 21/0094* (2013.01); *G03G 15/5033* (2013.01)

(58) Field of Classification Search
CPC ..... G03G 21/0094; G03G 21/007; G03G 15/5008
See application file for complete search history.

(56) References Cited

U.S. PATENT DOCUMENTS

2017/0285555 A1* 10/2017 Hagimoto ..... F16N 15/00
2018/0143581 A1* 5/2018 Nakayama ..... G03G 21/0094
2018/0373198 A1* 12/2018 Mizusawa ..... G03G 21/1814
2019/0101844 A1* 4/2019 Mochizuki ..... B05D 1/28

FOREIGN PATENT DOCUMENTS

JP 3406099 B2 5/2003
JP 2007-164105 A 6/2007
JP 5235846 B2 7/2013
JP 5790962 B2 10/2015
JP 6010852 B2 10/2016
JP 6120130 B2 4/2017

* cited by examiner

*Primary Examiner* — Jessica L Eley
(74) *Attorney, Agent, or Firm* — Rankin, Hill & Clark LLP

(57) ABSTRACT

An image forming apparatus includes: an image carrier; a lubricant applicator that applies a lubricant to the image carrier; a hardware processor; and a density unevenness measurer that is provided in the image forming apparatus or outside the image forming apparatus, and measures a first density unevenness for at least one of the density unevenness measurement image formed by the image former in the application unevenness detection mode or a density unevenness measurement image obtained by primary or subsequent transfer of the density unevenness measurement image, wherein the hardware processor detects the application unevenness of the lubricant applied by the lubricant applicator based on the first density unevenness measured by the density unevenness measurer.

28 Claims, 6 Drawing Sheets

IMAGE FORMING APPARATUS AND PROGRAM

The entire disclosure of Japanese patent Application No. 2020-140290, filed on Aug. 21, 2020, is incorporated herein by reference in its entirety.

BACKGROUND

Technological Field

The present invention relates to an image forming apparatus such as a copying machine, a printer, a facsimile apparatus, or a multifunction peripheral having functions of the plurality of apparatuses, and a program.

Description of the Related Art

As the image forming apparatus as described above, particularly, as an image forming apparatus employing an electrophotographic method as a printing method, one that applies a lubricant to a surface of a photoreceptor as an image carrier is known. The lubricant plays a role of reducing a friction coefficient of the surface of the photoreceptor and reducing loads on the photoreceptor and a cleaning device. The lubricant also plays a role of improving transfer efficiency of toner and protecting the photoreceptor from a discharge product.

Such a lubricant is applied to the photoreceptor by a lubricant application device. However, when the application performance is deteriorated due to temporal degradation or the like of the lubricant application device, an application amount of the lubricant changes and an application unevenness is likely to occur, and the effect of the lubricant on the photoreceptor cannot be sufficiently exhibited. Therefore, it is necessary to detect the application unevenness of the lubricant at an early stage.

JP 6010852 B2 discloses an image forming apparatus that calculates a life or a total consumption of a solid lubricant from a total travel distance or a total drive time of a lubricant supply roller.

JP 2007-164105 A discloses an image forming apparatus that measures the number of rotations of a lubricant application brush, holds correspondence data between the number of rotations of the lubricant application brush and a life of a solid lubricant, and determines the life of the solid lubricant from the measured number of rotations and the correspondence data.

Furthermore, JP 5790962 B2, JP 6120130 B2, JP 5235846 B2, and JP 3406099 B2 disclose techniques for detecting or determining a remaining amount of a lubricant.

However, JP 6010852 B2, JP 2007-164105 A, JP 5790962 B2, JP 6120130 B2, JP 5235846 B2, and JP 3406099 B2 disclose that the life of the lubricant application device is estimated by the travel distance, the drive time, or the number of rotations of the lubricant supply roller, or the remaining amount of the lubricant is directly detected, but do not sufficiently disclose a technique for accurately detecting the application unevenness of the lubricant at an early stage.

SUMMARY

An object of the present invention is to provide an image forming apparatus and a program capable of accurately detecting an application unevenness of a lubricant at an early stage.

Another object of the present invention is to provide an image forming apparatus and a program capable of calculating a replacement time or a next detection time of a lubricant applicator, controlling an application amount of the lubricant, controlling an image forming condition, and the like based on a detection result of the application unevenness of the lubricant.

To achieve at least one of the abovementioned objects, according to an aspect of the present invention, there is provided an image forming apparatus having an application unevenness detection mode, and the image forming apparatus reflecting one aspect of the present invention comprises: an image carrier; a lubricant applicator that applies a lubricant to the image carrier; a hardware processor that is capable of changing an application amount of the lubricant applied to the image carrier by the lubricant applicator, and detects an application unevenness of the lubricant applied by the lubricant applicator; an image former that forms an image on the image carrier to which the lubricant has been applied by the lubricant applicator, and forms, in the application unevenness detection mode, a density unevenness measurement image on the image carrier in a state where the application amount of the lubricant applied to the image carrier is changed by the hardware processor in association with a temporal change in the application amount; and a density unevenness measurer that is provided in the image forming apparatus or outside the image forming apparatus, and measures a first density unevenness for at least one of the density unevenness measurement image formed by the image former in the application unevenness detection mode or a density unevenness measurement image obtained by primary or subsequent transfer of the density unevenness measurement image, wherein the hardware processor detects the application unevenness of the lubricant applied by the lubricant applicator based on the first density unevenness measured by the density unevenness measurer.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
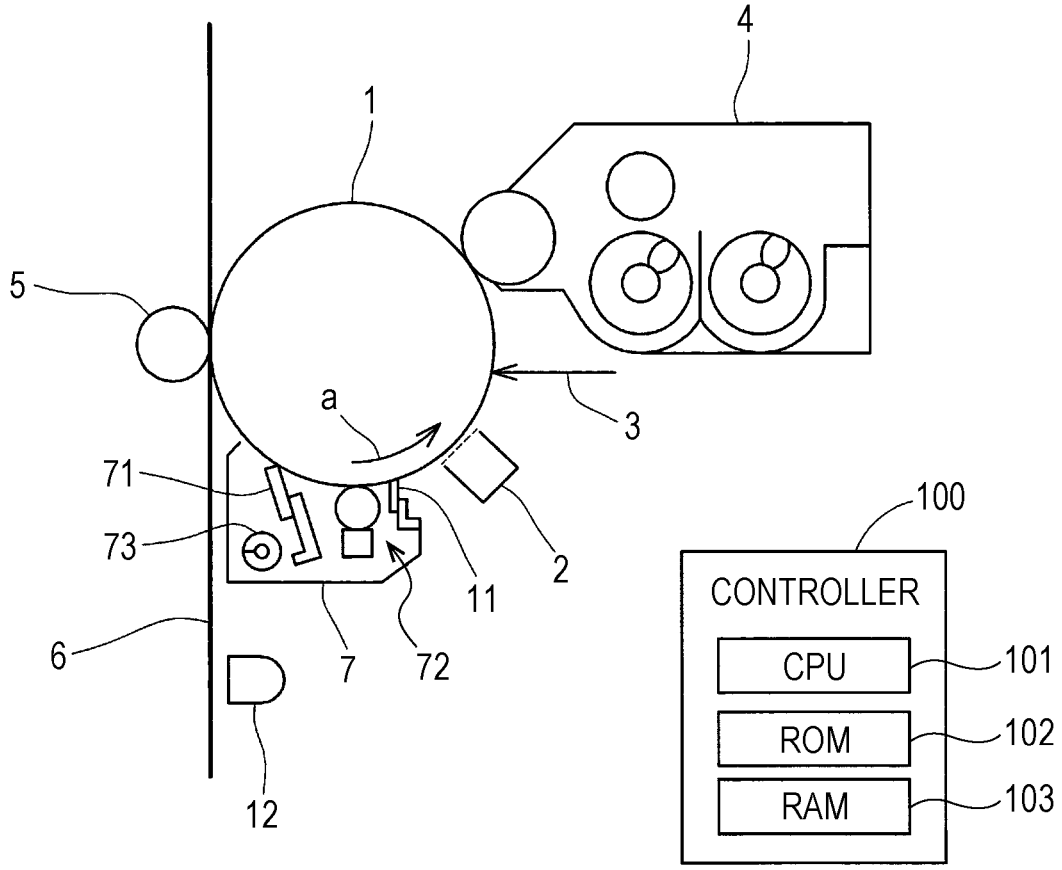
FIG. 1 is a cross-sectional view of a main part of an electrophotographic image forming apparatus according to an embodiment of the present invention.

FIG. 1 is a cross-sectional view of a main part of an electrophotographic image forming apparatus according to an embodiment of the present invention.

In FIG. 1, a reference numeral 1 denotes a photoreceptor drum as an image carrier to which a lubricant is applied. The photoreceptor drum 1 rotates in a direction of an arrow a, and a transfer unit including a charging unit 2, an exposure unit 3, a developing unit 4, a primary transfer member 5, an intermediate transfer belt 6, and the like, and a cleaning unit 7 are disposed around the photoreceptor drum 1 along a rotation direction.

The intermediate transfer belt 6 travels and moves downward from the top of the page of FIG. 1. A density sensor 12 that measures a density of an image is disposed at a position facing a surface (transfer surface) of the intermediate transfer belt 6 on a front side of the primary transfer member 5 in a moving direction of the intermediate transfer belt 6.

The cleaning unit 7 mainly includes a cleaning blade 71 that abuts on the photoreceptor drum 1, a lubricant application device 72, a conveying screw 73 that conveys collected toner to the outside of the cleaning unit 7, and the like.

In the image forming apparatus illustrated in FIG. 1, the exposure unit 3 exposes, according to image data, a surface of the photoreceptor drum 1 charged by the charging unit 2 to form an electrostatic latent image, and then the developing unit 4 develops the electrostatic latent image to form an image (toner image) on the surface of the photoreceptor drum 1.

In this embodiment, the image forming apparatus has a normal image forming mode and an application unevenness detection mode for image formation. In the image forming mode, the image formed on the photoreceptor drum 1 is primarily transferred to the intermediate transfer belt 6 by the primary transfer member 5. The image primarily transferred to the intermediate transfer belt 6 is conveyed to a secondary transfer position (not illustrated) by the intermediate transfer belt 6, and is transferred to a sheet by a secondary transfer member at the secondary transfer position. The image transferred to the sheet is fixed by a fixing device and discharged to the outside of the apparatus.

On the other hand, in the application unevenness detection mode, a density unevenness measurement image including a predetermined pattern image is formed on the photoreceptor drum 1, and the density unevenness measurement image is primarily transferred to the intermediate transfer belt 6 by the primary transfer member 5. A density of the density unevenness measurement image primarily transferred to the intermediate transfer belt 6 is measured by the density sensor 12 when the image passes through the density sensor 12, which accompanies the conveyance of the intermediate transfer belt 6, and a controller 100 described later calculates a density unevenness based on the measured density.

Note that the density unevenness measurement image formed on the intermediate transfer belt 6 may be erased without being secondarily transferred to a sheet after the density measurement. Furthermore, in this embodiment, the density unevenness measurement image is formed on the intermediate transfer belt 6, but the density of the density unevenness measurement image formed on the photoreceptor drum 1 may be measured, so that the density unevenness may be calculated.

Alternatively, the density unevenness measurement image on the intermediate transfer belt 6 may be secondarily transferred to a sheet and then fixed by the fixing device (not illustrated), and the density of the density unevenness measurement image fixed on the sheet may be measured, so that the density unevenness may be calculated. In this case, instead of the image forming apparatus measuring the density of the density unevenness measurement image and calculating the density unevenness, an external device such as an automatic quality optimization unit (IQ-501 manufactured by KONICA MINOLTA, INC.) or a scanner device connected to the image forming apparatus may read the density unevenness measurement image transferred to and fixed on the sheet and measure the density and/or calculate the density unevenness, and the image forming apparatus may receive the result to detect the application unevenness.

In addition, in an image forming apparatus not including the intermediate transfer belt 6, the density unevenness of the density unevenness measurement image formed on the photoreceptor drum 1 or the density unevenness of the density unevenness measurement image transferred to and fixed on a sheet can be measured.

Note that, in a color image forming apparatus including a plurality of photoreceptor drums 1, a density unevenness measurement image including a color image may be formed, or one of the plurality of photoreceptor drums 1, for example, a black photoreceptor drum 1 may be used to form a density unevenness measurement image.

On the photoreceptor drum 1 having the image transferred to the intermediate transfer belt 6, residual toner is removed and collected by the cleaning blade 71 of the cleaning unit 7. The collected toner is conveyed to the outside of the cleaning unit 7 by the conveying screw 73. The lubricant application device 72 applies the lubricant to the surface of the photoreceptor drum 1 from which the residual toner has been removed.

Figure 2:
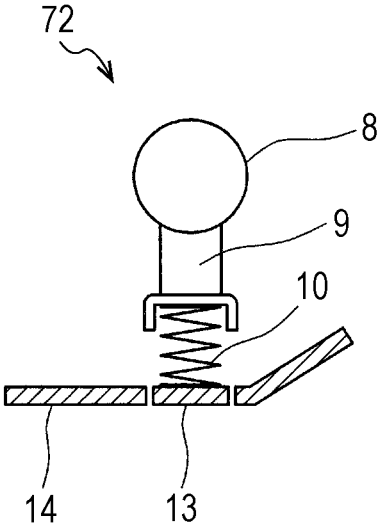
FIG. 2 is a diagram illustrating a configuration of a lubricant application device.

As illustrated in FIG. 2, the lubricant application device 72 includes a lubricant application brush 8, a solid lubricant 9, a pressing spring 10, and a uniformizing member 11 (illustrated in FIG. 1). The lubricant 9 is located below the lubricant application brush 8, is provided in pressure contact with a lower region of the lubricant application brush 8 with an upward biasing force applied by the pressing spring 10 from below, and supplies the lubricant to the lubricant application brush 8. The lubricant application brush 8 has a configuration in which a brush is disposed on a surface of a roller rotationally driven by a driver such as a motor (not illustrated), and is in contact with the surface of the photoreceptor drum 1. The roller of the lubricant application brush 8 is rotated when the photoreceptor drum 1 rotates, so that the lubricant supplied from the lubricant 9 is applied to the surface of the photoreceptor drum 1.

The lubricant plays a role of reducing a friction coefficient of the surface of the photoreceptor drum 1, reducing loads on the photoreceptor drum 1 and the cleaning unit 7, improving transfer efficiency of the toner, protecting the photoreceptor drum 1 from a discharge product, and the like.

The uniformizing member 11 plays a role of uniformly leveling the lubricant applied to the surface of the photoreceptor drum 1. Note that a lower end of the pressing spring 10 is fixed to a cover 13 attached to a housing 14.

The controller 100 includes a CPU 101, a ROM 102 in which an operation program of the CPU 101 and other data are stored, and a RAM 103 that serves as a work area when the CPU 101 operates, and comprehensively controls the entire image forming apparatus by the CPU 101 operating according to the operation program stored in the ROM 102 or the like.

Specifically, the controller 100 controls an image forming operation by an image former. The image former includes members relating to image formation, such as the photoreceptor drum 1, the charging unit 2, the exposure unit 3, the developing unit 4, the primary transfer member 5, the intermediate transfer belt 6, the cleaning unit 7, and the secondary transfer member (not illustrated).

Furthermore, the controller 100 changes an application amount of the lubricant applied to the photoreceptor drum 1 by the lubricant application device 72, calculates the density unevenness of the image from the density of the image measured by the density sensor 12, detects the application unevenness of the lubricant applied to the photoreceptor drum 1 based on the density unevenness, and performs various determinations and controls based on the detection result of the application unevenness. Details of these operations will be described later.

Incidentally, in the image forming apparatus including the lubricant application device 72, when the amount of lubricant on the surface of the photoreceptor drum 1 decreases to a predetermined amount or less, a predetermined amount or more of difference is likely to occur in the amount of lubricant between adjacent positions. That is, the application unevenness of the lubricant is likely to occur. When the application unevenness occurs, the density unevenness of the image occurs. This is because a surface potential of the photoreceptor drum 1 depends on the application amount of the lubricant.

Figure 3A:
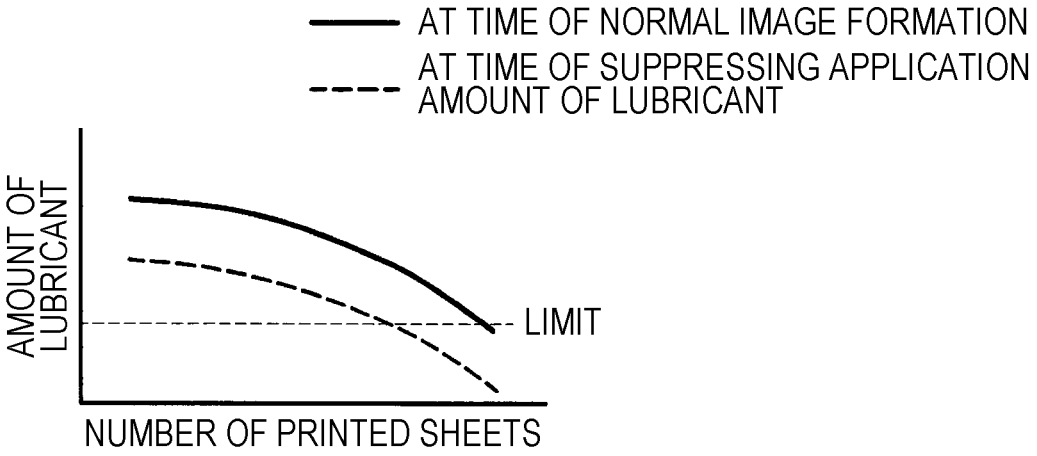
FIG. 3A is a diagram illustrating a relationship between the number of printed sheets and an application amount of a lubricant.

Specifically, as indicated by a solid line in FIG. 3A, the application amount of the lubricant changes in a decreasing direction due to deterioration or the like of the lubricant application device 72 as the number of printed sheets increases (the lubricant application device 72 endures the increase in the number of printed sheets), and the application unevenness occurs eventually. Furthermore, as indicated by a solid line in FIG. 3B, the density unevenness of the image increases as the number of printed sheets increases (the lubricant application device 72 endures the increase in the number of printed sheets), and eventually reaches the limit. As described above, there is a correlation between the occurrence of the application unevenness and the density unevenness. Therefore, if the density unevenness is measured, it is possible to know the application unevenness.

Figure 3B:
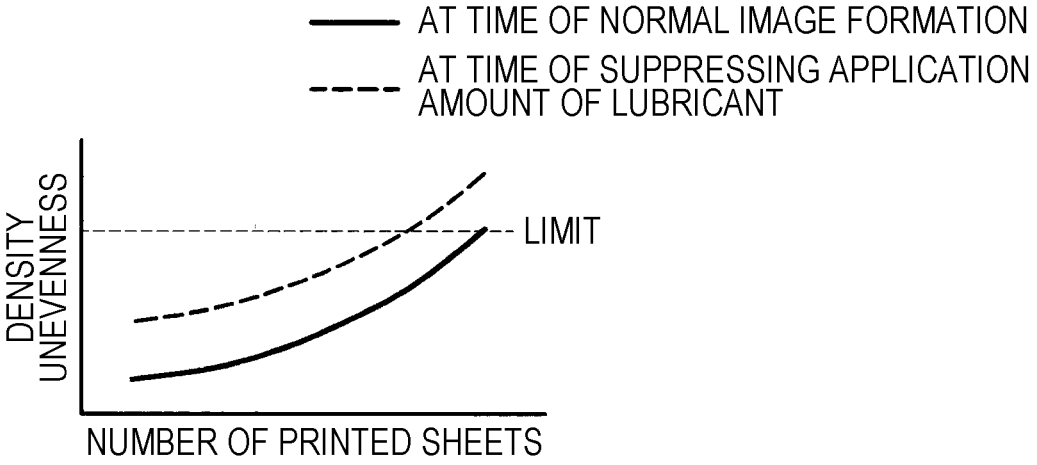
FIG. 3B is a diagram illustrating a relationship between the number of printed sheets and a density unevenness.

Even if the density unevenness does not occur under a normal lubricant application condition in which the application amount of the lubricant is not intentionally suppressed, temporarily suppressing the application amount of the lubricant greatly reduces the amount of lubricant on the photoreceptor drum 1 as compared with a case where the application amount of the lubricant is not suppressed, as indicated by a broken line in FIG. 3A, and also increases the difference in the amount of lubricant between portions, thereby increasing the density unevenness, as indicated by a broken line in FIG. 3B.

Thus, in the application unevenness detection mode, the application amount of the lubricant is temporarily suppressed to intentionally create a state where the application amount of the lubricant has changed (decreased) due to performance deterioration of the lubricant application device 72. If a density unevenness of an image formed in this state is measured, it is possible to accurately detect and predict at an early stage whether an occurrence status of the application unevenness has reached the limit and a limit time of the application performance of the lubricant application device 72. As will be described later, the limit time of the application performance of the lubricant application device 72 is calculated based on a difference from a reference value (threshold for determining the limit).

First Embodiment

An operation in the application unevenness detection mode of the image forming apparatus illustrated in FIG. 1 will be described with reference to a flowchart of FIG. 4. Processing illustrated in FIG. 4 and subsequent flowcharts is executed by the CPU 101 of the controller 100 operating according to the operation program stored in the ROM 102 or the like.

In this embodiment, the application unevenness of the lubricant is detected, and a life of the lubricant application device 72 is predicted based on the detection result.

First, in step S01, the density unevenness measurement image is formed under the normal condition, in other words, in a current state where the application amount of the lubricant is not suppressed.

Figure 5:
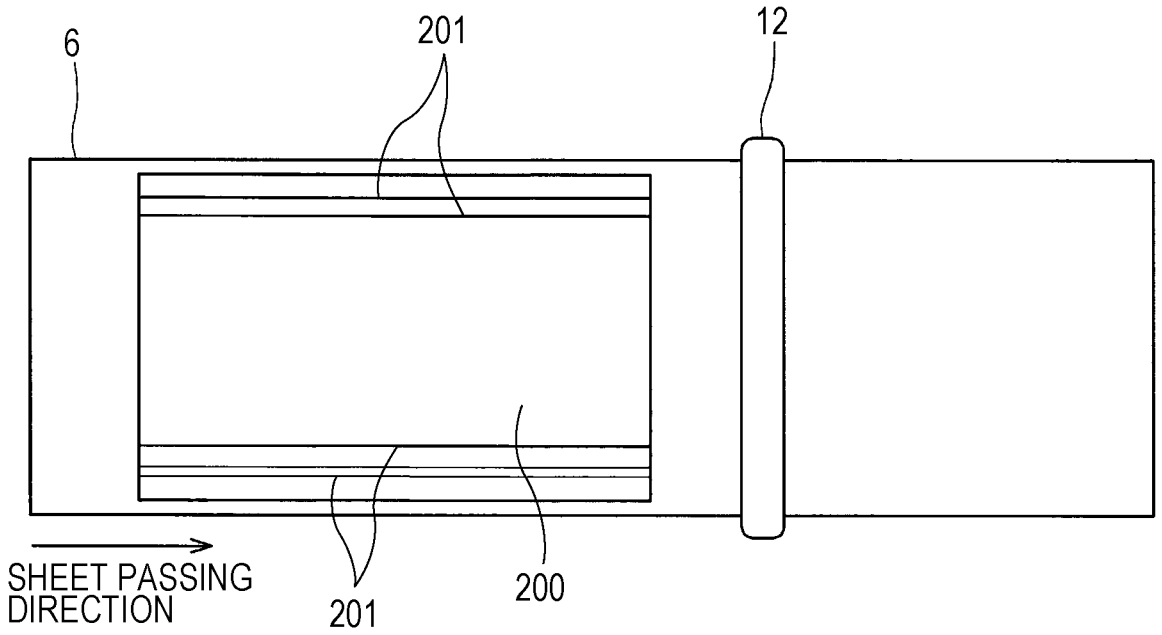
FIG. 5 is a plan view illustrating an intermediate transfer belt on which a density unevenness measurement image is formed.

Specifically, in step S011, a rotation speed of the lubricant application brush is set to a rotation speed at the time of normal image formation, and the lubricant is applied to the photoreceptor drum 1. In this state, the predetermined pattern image is formed as a halftone image on the photoreceptor drum 1. Next, the halftone image formed on the photoreceptor drum 1 is primarily transferred to the intermediate transfer belt 6, and as illustrated in FIG. 5, a density unevenness measurement image 200 is formed on the intermediate transfer belt 6. It is desirable, from the viewpoint of being capable of accurately measuring the density unevenness, to set the density of the density unevenness measurement image 200 to a density corresponding to a tone value of "64" when a solid image has a tone value of "256".

Next, density unevenness analysis processing is performed on the formed density unevenness measurement image 200 in step S02. Specifically, the density sensor 12 measures image densities at a plurality of positions in a direction (CD direction) orthogonal to a sheet passing direction (moving direction of the intermediate transfer belt 6), and transmits the measurement result to the controller 100. The image density at each measurement position is calculated by use of data measured a plurality of times in the sheet passing direction (FD direction). The controller 100 calculates a density unevenness (corresponding to a second density unevenness) based on the densities received from the density sensor 12. The density unevenness is defined by a maximum value of density differences at all the measurement positions when a density difference from an adjacent measurement position is calculated at each measurement position in the CD direction. Note that, in the density unevenness measurement image 200 in FIG. 5, a plurality of linear noises 201 along the sheet passing direction (FD direction) is generated due to the application unevenness of the lubricant applied to the photoreceptor drum 1.

Next, in step S03, the density unevenness measurement image is formed in a state where the application amount of the lubricant applied to the photoreceptor drum 1 is suppressed. Specifically, in step S031, the rotation speed of the lubricant application brush 8 is set to 80% of the rotation speed at the time of normal image formation, and the lubricant is applied to the photoreceptor drum 1. In this state, a halftone image is formed on the photoreceptor drum 1, and then the halftone image is primarily transferred to the intermediate transfer belt 6 to form the density unevenness measurement image 200. The density of the density unevenness measurement image 200 is preferably set to the same tone value as that of the normal image formation described above. Note that the change of the rotation speed of the lubricant application brush 8 for reducing the application amount may include a rotation stop.

Next, in step S04, the density unevenness analysis processing is performed on the formed density unevenness measurement image 200, and a density unevenness (corresponding to a first density unevenness) is calculated. This processing is performed in the same procedure as the density unevenness analysis processing at the time of normal image formation in step S02.

In step S05, the density unevenness (second density unevenness) at the time of normal image formation, which is calculated in step S02, and the density unevenness (first density unevenness) at the time of suppressing the application amount of the lubricant, which is calculated in step S04, are compared with the preset reference value (threshold for determining the limit) to detect the application unevenness and calculate a replacement time of the lubricant application device 72.

Specifically, in step S05, in a case where both the density unevenness at the time of normal image formation and the density unevenness at the time of suppressing the application amount of the lubricant exceed the reference value, it is determined in step S06 that the application unevenness has reached the limit and the lubricant application device 72 exceeds a margin of the life. In this case, for example, a message prompting replacement of the lubricant application device 72 is displayed on an operation panel (not illustrated) or the like.

Note that, in the replacement of the lubricant application device 72, only the lubricant 9 may be replaced, or a cartridge in which the lubricant 9 and the lubricant application brush 8 are integrated may be replaced. Furthermore, in a case where the lubricant application device 72 is integrated with a process cartridge such as the photoreceptor drum 1, the process cartridge may be replaced.

In step S05, in a case where the density unevenness at the time of normal image formation does not exceed the reference value, and only the density unevenness at the time of suppressing the application amount of the lubricant exceeds the reference value, it is determined in step S07 that the application unevenness has not reached the limit, but a timing at which the limit is reached is close, and the replacement time is calculated. The replacement time is calculated by the following equation based on a ratio between the differences between the density unevennesses and the reference value.

$$\text{Replacement time} = \text{Replacement coefficient} \times (Z-X) \div (Y-Z)$$

The density unevenness at the time of normal image formation is X, the density unevenness at the time of suppressing the application amount of the lubricant is Y, and the reference value is Z.

In step S05, in a case where the density unevenness at the time of suppressing the application amount of the lubricant is equal to or less than the reference value (in this case, the density unevenness at the time of normal image formation is also equal to or less than the reference value), it is determined in step S08 that the application unevenness has not reached the limit, there is a margin in the life, and it is not necessary to replace the lubricant application device 72 for the time being.

As described above, in this embodiment, in the application unevenness detection mode, a future state where the application amount of the lubricant is reduced due to the performance deterioration of the lubricant application device 72 is intentionally created in a state where the application amount of the lubricant applied to the photoreceptor drum 1 is suppressed. In this state, the density unevenness measurement image is formed to calculate the density unevenness and compare the density unevenness with the reference value, so that the application unevenness of the lubricant applied by the lubricant application device 72 is detected. Therefore, even if the application unevenness has not reached the limit and the lubricant application device 72 has not reached the end of the life at the time of detecting the application unevenness, it is possible to detect at an early stage and in advance whether the lubricant application device 72 reaches the end of the life and the application unevenness reaches the limit in the near future. Moreover, since the density unevenness larger than the actual density unevenness can be obtained, the application unevenness can be accurately detected. In addition, the timing at which the lubricant application device 72 reaches the end of the life can be accurately calculated based on the detection result of the application unevenness.

Note that the detection of the application unevenness in the application unevenness detection mode can be performed every predetermined number of printed sheets (for example, every 50,000 sheets). In addition, a detection interval may be lengthened or shortened. If the detection interval is shortened, the detection accuracy is enhanced. Furthermore, a detection time may be changed according to an endurance number of sheets. For example, the detection interval may be lengthened (for example, every 100,000 sheets) when the density unevenness at the time of suppressing the application amount of the lubricant is equal to or less than the reference value, and the detection interval may be shortened (for example, every 10,000 sheets) when the density unevenness at the time of suppressing the application amount of the lubricant exceeds the reference value. Note that the detection time may be changed according to an installation environment or a printing rate, such as shortening the detection interval when the temperature is low or the printing rate is high.

Second Embodiment

Figure 6:
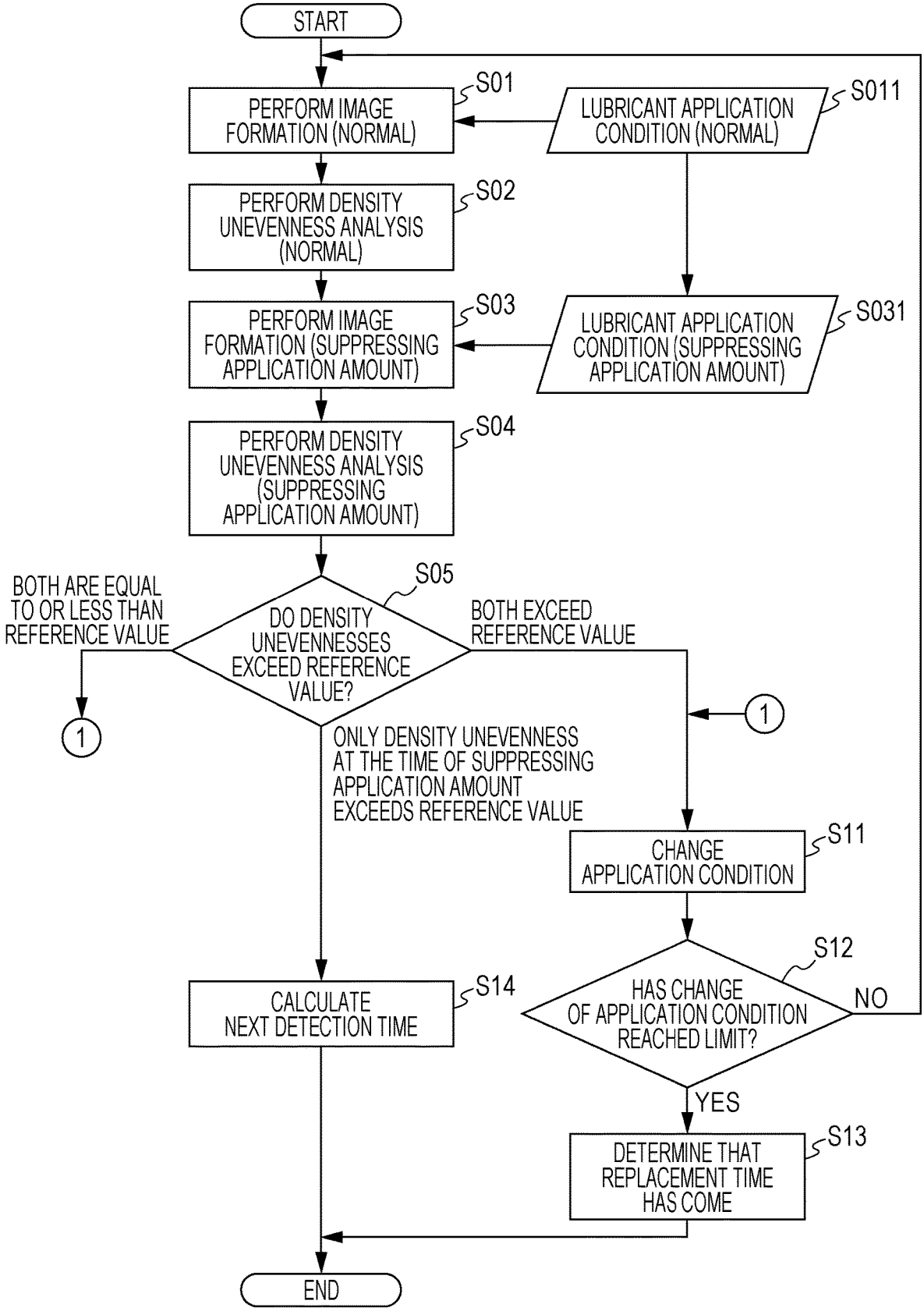
FIG. 6 is a flowchart for describing another operation in the application unevenness detection mode of the image forming apparatus.

Another operation in the application unevenness detection mode of the image forming apparatus illustrated in FIG. 1 will be described with reference to a flowchart of FIG. 6.

In this embodiment, the application unevenness of the lubricant is detected, and the application amount at the time of image formation by the lubricant application device 72 is controlled based on the detection result.

Figure 4:
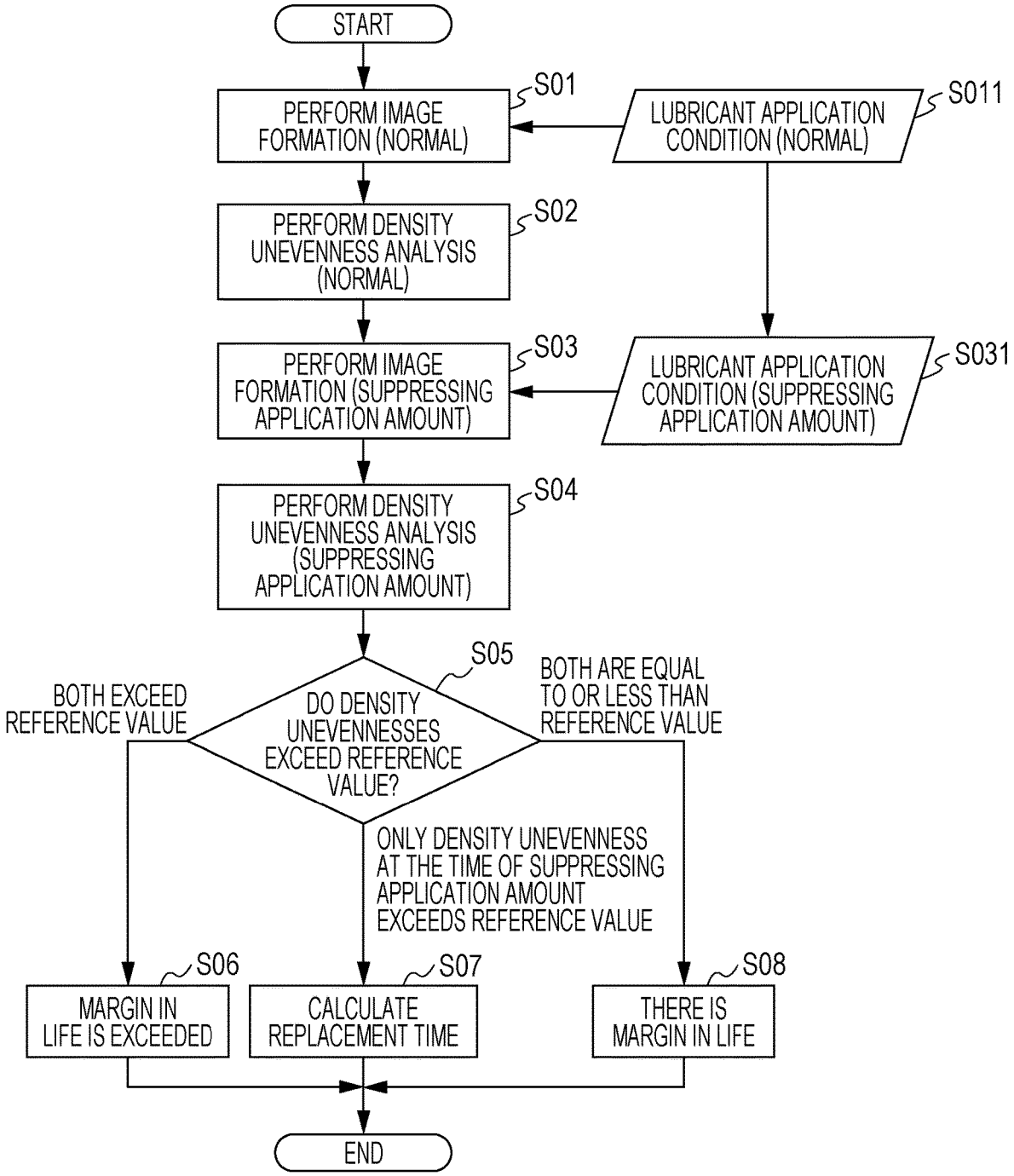
FIG. 4 is a flowchart for describing an operation in an application unevenness detection mode of the image forming apparatus.

Since the processing of forming the density unevenness measurement image under the normal condition in step S01, the processing of setting the rotation speed of the lubricant application brush to the rotation speed at the time of normal image formation and applying the lubricant to the photoreceptor drum 1 in step S011, the density unevenness analysis processing in step S02, the processing of forming the density unevenness measurement image in a state where the application amount of the lubricant applied to the photoreceptor drum 1 is suppressed in step S03, the processing of setting the rotation speed of the lubricant application brush to 80% of the rotation speed at the time of normal image formation and applying the lubricant to the photoreceptor drum 1 in step S031, the density unevenness analysis processing in step S04, and the comparison processing in step S05 are the same as the processing in each step in the first embodiment illustrated in FIG. 4, the same step numbers are given, and detailed description thereof will be omitted.

In step S05, the density unevenness at the time of normal image formation, which is calculated in step S02, and the density unevenness at the time of suppressing the application amount of the lubricant, which is calculated in step S04, are compared with the preset reference value, and an application condition (application amount) of the lubricant application device 72 is controlled according to the detection result and the comparison result of the application unevenness.

Specifically, in a case where both the density unevenness at the time of normal image formation and the density unevenness at the time of suppressing the application amount of the lubricant exceed the reference value, it is determined in step S11 that the application unevenness has reached the limit, and the rotation speed of the lubricant application brush 8 is changed by a predetermined amount (for example, 1.1 times the linear speed) to increase the application amount of the lubricant.

To change the application amount of the lubricant, the rotation speed of the lubricant application brush 8 can be changed, which includes the rotation stop. Alternatively, to change the application amount of the lubricant, an electromagnetic actuator or the like may press or pull a position of the cover 13 to which the lower end of the pressing spring 10 is attached with respect to the pressing spring 10, so that a pressing force of the pressing spring 10 that presses the lubricant 9 against the lubricant application brush 8 may be changed. Alternatively, the rotation speed of the lubricant application brush 8 and the pressing force of the pressing spring 10 may be changed at the same time.

Next, in step S12, it is determined whether an increase in the application amount of the lubricant has reached the upper limit, and if the increase amount has not reached the upper limit (NO in step S12), the processing returns to step S01 and steps S01 to S05 are repeated. In step S05, the change of the rotation speed of the lubricant application brush and the measurement of the density unevenness are repeated until the density unevenness at the time of normal image formation is equal to or less than the reference value and the density unevenness at the time of suppressing the application amount of the lubricant exceeds the reference value. Note that, when the increase in the application amount due to the change of the rotation speed of the lubricant application brush has reached the limit (YES in step S12), it is determined in step S13 that the replacement time of the lubricant application device 72 has come.

In step S05, when the density unevenness at the time of suppressing the application amount of the lubricant is equal to or less than the reference value (the density unevenness at the time of normal image formation is also equal to or less than the reference value), it is determined that the application unevenness has not reached the limit but the application amount of the lubricant is excessive, and, in step S011, the rotation speed of the lubricant application brush 8 is changed by a predetermined amount (for example, 0.9 times the linear speed). After the change, the density unevenness is measured again, and the change of the rotation speed of the lubricant application brush 8 and the measurement of the density unevenness are repeated until the density unevenness at the time of normal image formation is equal to or less than the reference value and the density unevenness at the time of suppressing the application amount of the lubricant exceeds the reference value.

In step S05, when the density unevenness at the time of normal image formation is equal to or less than the reference value and the density unevenness at the time of suppressing the application amount of the lubricant exceeds the reference value, it is determined that the timing at which the application unevenness reaches the limit is close but has not yet come and the application amount of the lubricant is also appropriate. In step S14, the next application unevenness detection time in the application unevenness detection mode is calculated, and then the processing is ended.

The next detection time in step S14 is calculated by the following equation.

$$\text{Next detection time} = \text{Detection time coefficient} \times (Z - X) \div (Y - Z)$$

The density unevenness at the time of normal image formation is X, the density unevenness at the time of suppressing the application amount of the lubricant is Y, and the reference value is Z.

Note that, in a case where the lubricant application condition is changed in step S11, an image is formed in the image forming mode under the changed condition.

As described above, in this embodiment, in the case where both the density unevenness at the time of normal image formation and the density unevenness at the time of suppressing the application amount of the lubricant exceed the reference value, it is determined that the application unevenness has reached the limit, and the rotation speed of the lubricant application brush 8 is changed to increase the application amount of the lubricant. Therefore, the lubricant application device 72 can be used to the limit at which the lubricant application device 72 reaches the end of the life, so that it is possible to perform good image formation.

On the other hand, in the case where the density unevenness at the time of suppressing the application amount of the lubricant is equal to or less than the reference value, it is determined that the application unevenness has not reached the limit, but the lubricant is excessive, and the rotation speed of the lubricant application brush 8 is changed to reduce the application amount of the lubricant. Therefore, setting the application amount of the lubricant to an appropriate value makes it possible to perform good image formation, and in addition, to suppress wasteful consumption of the lubricant.

In the above example, the change control of the application amount of the lubricant applied to the photoreceptor drum 1 is performed in both the case where both the density unevenness at the time of normal image formation and the density unevenness at the time of increasing the detection sensitivity exceed the reference value and the case where the density unevenness at the time of increasing the detection sensitivity is equal to or less than the reference value. However, the change control of the application amount of the lubricant applied to the photoreceptor drum 1 may be performed only in one of the cases.

Third Embodiment

Figure 7:
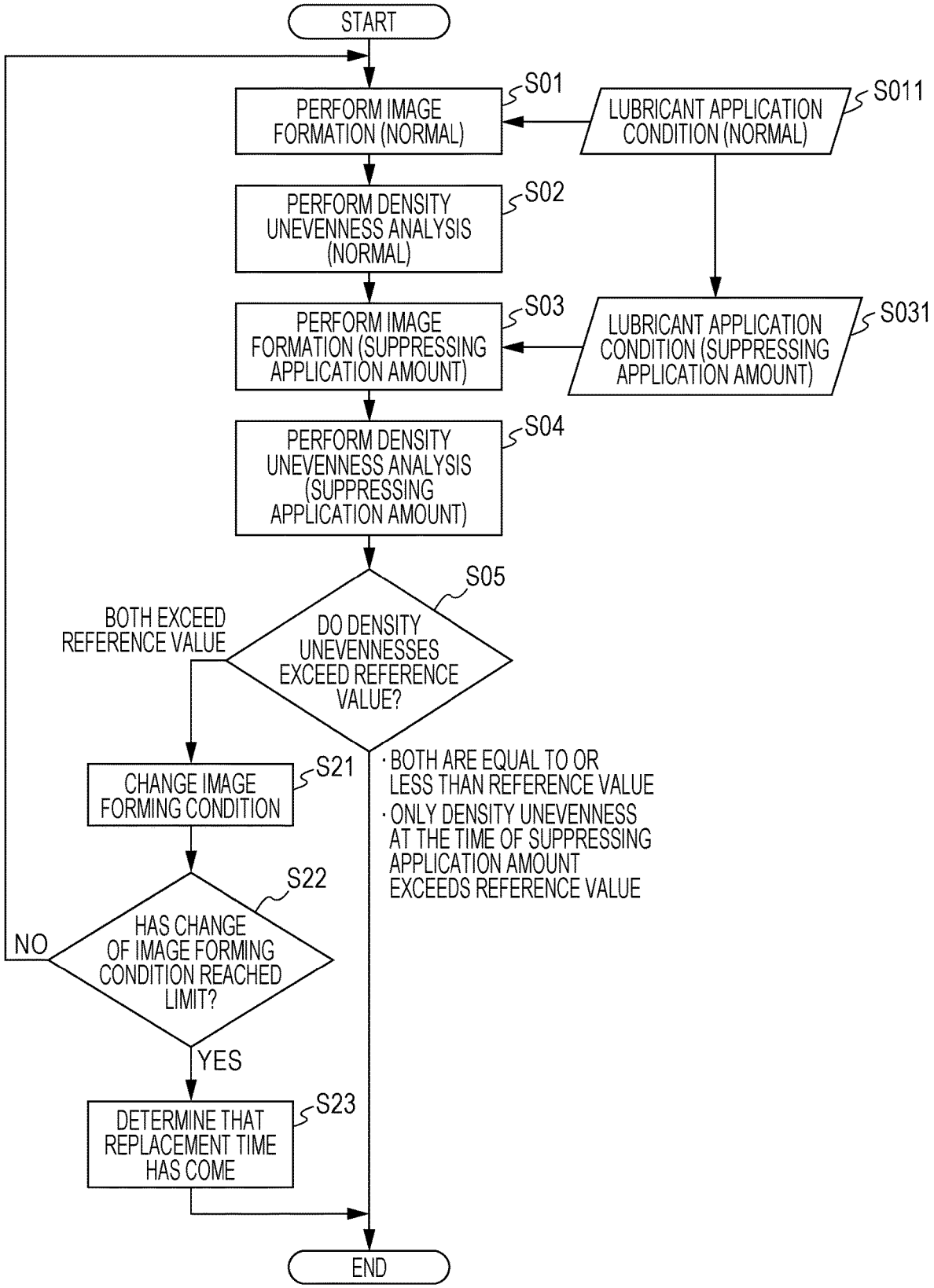
FIG. 7 is a flowchart for describing still another operation in the application unevenness detection mode of the image forming apparatus.

Still another operation in the application unevenness detection mode of the image forming apparatus illustrated in FIG. 1 will be described with reference to a flowchart of FIG. 7.

In this embodiment, the application unevenness of the lubricant is detected, and an image forming condition in the normal image forming mode is controlled based on the detection result.

Since the processing of forming the density unevenness measurement image under the normal condition in step S01, the processing of setting the rotation speed of the lubricant application brush 8 to the rotation speed at the time of normal image formation and applying the lubricant to the photoreceptor drum 1 in step S011, the density unevenness analysis processing in step S02, the processing of forming the density unevenness measurement image in a state where the application amount of the lubricant applied to the photoreceptor drum 1 is suppressed in step S03, the processing of setting the rotation speed of the lubricant application brush 8 to 80% of the rotation speed at the time of normal image formation and applying the lubricant to the photoreceptor drum 1 in step S031, the density unevenness analysis processing in step S04, and the comparison processing in step S05 are the same as the processing in each step in the first embodiment illustrated in FIG. 4, the same step numbers are given, and detailed description thereof will be omitted.

In step S05, the density unevenness at the time of normal image formation, which is calculated in step S02, and the density unevenness at the time of suppressing the application amount of the lubricant, which is calculated in step S04, are compared with the preset reference value, and the image forming condition is controlled according to the comparison result.

Specifically, in a case where both the density unevenness at the time of normal image formation and the density unevenness at the time of suppressing the application amount of the lubricant exceed the reference value, it is determined that the application unevenness has reached the limit, and the image forming condition is changed in step S21.

Next, in step S22, it is determined whether the change of the image forming condition has reached the limit, and if the change has not reached the limit (NO in step S22), the processing returns to step S01 and steps S01 to S05 are repeated.

The image forming condition to be changed is preferably at least one of a charging potential of the photoreceptor drum 1, a voltage (developing bias) to be applied to a developer carrier, an alternating current (AC) voltage of the developing bias, or a frequency of the AC voltage of the developing bias. For example, both the charging potential and the developing bias are changed by −50V. In a case where the AC voltage of the developing bias is changed, the AC voltage is increased by, for example, 100 V, and in a case where the frequency of the AC voltage is changed, the frequency is increased by, for example, 1.1 times.

After the change, the density unevenness measurement image is formed again to calculate the density unevenness, and the change of the image forming condition and the measurement of the density unevenness are repeated until the density unevenness at the time of normal image formation is equal to or less than the reference value and the density unevenness at the time of increasing the detection sensitivity exceeds the reference value. Note that, when the change of the image forming condition reaches the limit (YES in step S22), it is determined in step S23 that the replacement time of the lubricant application device 72 has come.

In step S05, when the density unevenness at the time of increasing the detection sensitivity is equal to or less than the reference value (the density unevenness at the time of normal image formation is also equal to or less than the reference value), it is determined that the image forming condition does not need to be changed, and the processing is ended without doing anything. Similarly, when the density unevenness at the time of normal image formation is equal to or less than the reference value and the density unevenness at the time of increasing the detection sensitivity exceeds the reference value, it is determined that the image forming condition does not need to be changed, and the processing is ended without doing anything.

Note that, in a case where the image forming condition is changed in step S21, an image is formed in the image forming mode under the changed condition.

As described above, in this embodiment, in the case where both the density unevenness at the time of normal image formation and the density unevenness at the time of increasing the detection sensitivity exceed the reference value, the image forming condition is changed, and an image is formed in the image forming mode under the changed condition. Therefore, the lubricant application device 72 can be used to the limit at which the lubricant application device 72 reaches the end of the life, so that it is possible to perform good image formation.

According to an embodiment of the present invention, a lubricant is applied to an image carrier by a lubricant applicator, and an image former forms, in an application unevenness detection mode, a density unevenness measurement image on the image carrier in a state where an application amount of the lubricant applied to the image carrier is changed in association with a temporal change in the application amount.

A first density unevenness is measured for at least one of the density unevenness measurement image formed in the application unevenness detection mode or a density unevenness measurement image obtained by primary or subsequent transfer of the density unevenness measurement image, and an application unevenness of the lubricant applied to the image carrier is detected based on the measured first density unevenness.

According to an embodiment of the present invention, the density unevenness measurement image is formed in a state where the application amount is decreased by an application amount changing unit, and the density unevenness is measured. Thus, it is possible to more accurately and reliably detect the application unevenness.

According to an embodiment of the present invention, the first density unevenness is compared with a reference value, and it is determined that the application unevenness has not reached a limit in a case where the first density unevenness is equal to or less than the reference value, and it is determined that the application unevenness has already reached the occurrence limit or a timing at which the application unevenness reaches the limit is close in a case where the first density unevenness exceeds the reference value. Thus, it is possible to detect at an early stage that the application unevenness has already reached the limit or the timing at which the application unevenness reaches the limit is close.

According to an embodiment of the present invention, a second density unevenness is measured for at least one of density unevenness measurement images formed without changing the application amount of the lubricant, and in a case where the first density unevenness exceeds the reference value, it is determined that the application unevenness has already reached the limit when the second density unevenness exceeds the reference value, and it is determined that the timing at which the application unevenness reaches the limit is close when the second density unevenness is equal to or less than the reference value. Thus, it is possible to reliably detect that the application unevenness has already reached the limit and that the timing at which the application unevenness reaches the limit is close.

According to an embodiment of the present invention, it is possible to reliably change the application amount of the lubricant in the application unevenness detection mode by at least one of changing a rotation speed of a lubricant application brush, which includes a rotation stop, or changing a lubricant pressing force applied to the lubricant application brush.

According to an embodiment of the present invention, a density unevenness of a halftone image as the density unevenness measurement image is measured in the application unevenness detection mode. Thus, it is possible to measure the density unevenness with high accuracy, and furthermore, to detect the application unevenness of the lubricant with high accuracy.

According to an embodiment of the present invention, it is possible to calculate a replacement time of the lubricant applicator based on a detection result of the application unevenness.

According to an embodiment of the present invention, the second density unevenness is measured for at least one of the density unevenness measurement images formed without changing the application amount of the lubricant, and the replacement time of the lubricant applicator is calculated in a case where the first density unevenness exceeds the reference value and the second density unevenness is equal to or less than the reference value.

According to an embodiment of the present invention, it is possible to control the application amount of the lubricant applied to the image carrier by the lubricant applicator based on the detection result of the application unevenness.

According to an embodiment of the present invention, the second density unevenness is measured for at least one of the density unevenness measurement images formed without changing the application amount of the lubricant, and the application amount of the lubricant applied to the image carrier by the lubricant applicator is controlled in a case where the first density unevenness is equal to or less than the reference value and/or in a case where both the first density unevenness and the second density unevenness exceed the reference value.

According to an embodiment of the present invention, it is possible to calculate a next application unevenness detection time based on the detection result of the application unevenness.

According to an embodiment of the present invention, the second density unevenness is measured for at least one of the density unevenness measurement images formed without changing the application amount of the lubricant, and the next application unevenness detection time is calculated in a case where the first density unevenness exceeds the reference value and the second density unevenness is equal to or less than the reference value.

According to an embodiment of the present invention, it is possible to control an image forming condition of the image former based on the detection result of the application unevenness.

According to an embodiment of the present invention, the second density unevenness is measured for at least one of the density unevenness measurement images formed without changing the application amount of the lubricant, and the image forming condition is controlled in a case where both the first density unevenness and the second density unevenness exceed the reference value.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus having an application unevenness detection mode, the image forming apparatus comprising:

an image carrier;

a lubricant applicator that applies a lubricant to the image carrier;

a hardware processor that is capable of changing an application amount of the lubricant applied to the image carrier by the lubricant applicator, and detects an application unevenness of the lubricant applied by the lubricant applicator;

an image former that forms an image on the image carrier to which the lubricant has been applied by the lubricant applicator, and forms, in the application unevenness detection mode, a density unevenness measurement image on the image carrier in a state where the application amount of the lubricant applied to the image carrier is changed by the hardware processor in association with a temporal change in the application amount; and a density unevenness measurer that is provided in the image forming apparatus or outside the image forming apparatus, and measures a first density unevenness for at least one of the density unevenness measurement image formed by the image former in the application unevenness detection mode or a density unevenness measurement image obtained by primary or subsequent transfer of the density unevenness measurement image, wherein the hardware processor detects the application unevenness of the lubricant applied by the lubricant applicator based on the first density unevenness measured by the density unevenness measurer.

2. The image forming apparatus according to claim 1, wherein the change in the application amount in association with the temporal change, which is made by the hardware processor, is a decrease in the application amount.

3. The image forming apparatus according to claim 1, wherein the hardware processor compares the first density unevenness with a reference value, determines that the application unevenness has not reached a limit in a case where the first density unevenness is equal to or less than the reference value, and determines that the application unevenness has already reached the limit or a timing at which the application unevenness reaches the limit is close in a case where the first density unevenness exceeds the reference value.

4. The image forming apparatus according to claim 3, wherein the density unevenness measurer measures a second density unevenness for at least one of density unevenness measurement images formed without changing the application amount of the lubricant, and in a case where the first density unevenness exceeds the reference value, the hardware processor determines that the application unevenness has already reached the limit when the second density unevenness exceeds the reference value, and determines that the timing at which the application unevenness reaches the limit is close when the second density unevenness is equal to or less than the reference value.

5. The image forming apparatus according to claim 1, wherein the lubricant applicator includes a lubricant application brush that is rotatable and applies the lubricant to the image carrier, and a presser that presses the lubricant against the lubricant application brush to supply the lubricant to the lubricant application brush, and the hardware processor changes the application amount of the lubricant by at least one of changing a rotation speed of the lubricant application brush, which includes a rotation stop, or changing a lubricant pressing force applied to the lubricant application brush.

6. The image forming apparatus according to claim 1, wherein the image former forms, in the application unevenness detection mode, the density unevenness measurement image as a halftone image.

7. The image forming apparatus according to claim 1, wherein the hardware processor further calculates a replacement time of the lubricant applicator based on a detection result of the application unevenness detected by the hardware processor.

8. The image forming apparatus according to claim 7, wherein the density unevenness measurer measures a second density unevenness for at least one of density unevenness measurement images formed without changing the application amount of the lubricant, and the hardware processor calculates the replacement time of the lubricant applicator in a case where the first density unevenness exceeds a reference value and the second density unevenness is equal to or less than the reference value.

9. The image forming apparatus according to claim 1, wherein the hardware processor further controls the application amount of the lubricant applied to the image carrier by the lubricant applicator based on a detection result of the application unevenness detected by the hardware processor.

10. The image forming apparatus according to claim 9, wherein the density unevenness measurer measures a second density unevenness for at least one of density unevenness measurement images formed without changing the application amount of the lubricant, and the hardware processor controls the application amount of the lubricant applied to the image carrier by the lubricant applicator in a case where the first density unevenness is equal to or less than a reference value and/or in a case where both the first density unevenness and the second density unevenness exceed the reference value.

11. The image forming apparatus according to claim 1, wherein the hardware processor further calculates a next application unevenness detection time based on a detection result of the application unevenness detected by the hardware processor.

12. The image forming apparatus according to claim 11, wherein the density unevenness measurer measures a second density unevenness for at least one of density unevenness measurement images formed without changing the application amount of the lubricant, and the hardware processor calculates the next application unevenness detection time in a case where the first density unevenness exceeds a reference value and the second density unevenness is equal to or less than the reference value.

13. The image forming apparatus according to claim 1, wherein the hardware processor further controls an image forming condition of the image former based on a detection result of the application unevenness detected by the hardware processor.

14. The image forming apparatus according to claim 13, wherein the density unevenness measurer measures a second density unevenness for at least one of density unevenness measurement images formed without changing the application amount of the lubricant, and the hardware processor controls the image forming condition in a case where both the first density unevenness and the second density unevenness exceed a reference value.

15. A non-transitory recording medium storing a computer readable program for causing a computer of an image forming apparatus having an application unevenness detection mode and including an image carrier and a lubricant applicator that applies a lubricant to the image carrier to execute:

changing, in the application unevenness detection mode, an application amount of the lubricant applied to the image carrier by the lubricant applicator in association with a temporal change in the application amount;

forming an image on the image carrier to which the lubricant has been applied by the lubricant applicator, and forming, in the application unevenness detection mode, a density unevenness measurement image on the image carrier in a state where the application amount of the lubricant applied to the image carrier is changed; and detecting an application unevenness of the lubricant applied by the lubricant applicator based on a first density unevenness measured for at least one of the density unevenness measurement image formed on the image carrier in the forming the density unevenness measurement image, or a density unevenness measurement image obtained by primary or subsequent transfer of the density unevenness measurement image.

16. The non-transitory recording medium storing a computer readable program according to claim 15, wherein the change in the application amount in association with the temporal change in the changing the application amount is a decrease in the application amount.

17. The non-transitory recording medium storing a computer readable program according to claim 15, wherein, in the detecting the application unevenness, the computer readable program causes the computer to execute processing of comparing the first density unevenness with a reference value, determining that the application unevenness has not reached a limit in a case where the first density unevenness is equal to or less than the reference value, and determining that the application unevenness has already reached the limit or a timing at which the application unevenness reaches the limit is close in a case where the first density unevenness exceeds the reference value.

18. The non-transitory recording medium storing a computer readable program according to claim 17, wherein, in the detecting the application unevenness, in a case where the first density unevenness exceeds the reference value, it is determined that the application unevenness has already reached the limit when a second density unevenness measured for at least one of density unevenness measurement images formed without changing the application amount of the lubricant exceeds the reference value, and it is determined that the timing at which the application unevenness reaches the limit is close when the second density unevenness is equal to or less than the reference value.

19. The non-transitory recording medium storing a computer readable program according to claim 15, wherein the lubricant applicator includes a lubricant application brush that applies the lubricant to the image carrier to which the lubricant is applied, and a presser that presses the lubricant against the lubricant application brush to supply the lubricant to the lubricant application brush, and the computer readable program causes the computer to execute processing of changing the application amount of the lubricant by at least one of changing a rotation speed of the lubricant application brush, which includes a rotation stop, or changing a lubricant pressing force applied to the lubricant application brush.

20. The non-transitory recording medium storing a computer readable program according to claim 15, wherein the computer readable program causes the computer to execute processing of forming, by an image former, the density unevenness measurement image as a halftone image in the application unevenness detection mode.

21. The non-transitory recording medium storing a computer readable program according to claim 15, wherein the computer readable program further causes the computer to execute calculating a replacement time of the lubricant applicator based on a detection result of the application unevenness in the detecting the application unevenness.

22. The non-transitory recording medium storing a computer readable program according to claim 21, wherein, in a case where the first density unevenness exceeds a reference value, and a second density unevenness measured for at least one of density unevenness measurement images formed without changing the application amount of the lubricant is equal to or less than the reference value, the replacement time of the lubricant applicator is calculated in the calculating the replacement time.

23. The non-transitory recording medium storing a computer readable program according to claim 15, wherein the computer readable program further causes the computer to execute controlling the application amount of the lubricant applied by the lubricant applicator in the application unevenness detection mode based on a detection result of the application unevenness in the detecting the application unevenness.

24. The non-transitory recording medium storing a computer readable program according to claim 23, wherein, in a case where the first density unevenness is equal to or less than a reference value and/or in a case where the first density unevenness exceeds the reference value and a second density unevenness measured for at least one of density unevenness measurement images formed without changing the application amount of the lubricant exceeds the reference value, the application amount of the lubricant applied to the image carrier is controlled in the controlling the application amount.

25. The non-transitory recording medium storing a computer readable program according to claim 15, wherein the computer readable program further causes the computer to execute calculating a next application unevenness detection time based on a detection result of the application unevenness in the detecting the application unevenness.

26. The non-transitory recording medium storing a computer readable program according to claim 25, wherein, in a case where the first density unevenness exceeds a reference value, and a second density unevenness measured for at least one of density unevenness measurement images formed without changing the application amount of the lubricant is equal to or less than the reference value, the next application unevenness detection time is calculated in the calculating the next application unevenness detection time.

27. The non-transitory recording medium storing a computer readable program according to claim 15, wherein the computer readable program further causes the computer to execute controlling an image forming condition based on a detection result of the application unevenness in the detecting the application unevenness.

28. The non-transitory recording medium storing a computer readable program according to claim 27, wherein, in a case where the first density unevenness exceeds a reference value, and a second density unevenness measured for at least one of density unevenness measurement images formed without changing the application amount of the lubricant exceeds the reference value, the image forming condition is controlled in the controlling the image forming condition.

* * * * *